United States Patent [19]

Shadford

[11] 4,358,106

[45] Nov. 9, 1982

[54] EXERCISING STAND

[76] Inventor: Alan R. Shadford, 68620½ Broadway, Cathedral City, Calif. 92234

[21] Appl. No.: 225,675

[22] Filed: Jan. 16, 1981

[51] Int. Cl.[3] ..... A63B 23/02

[52] U.S. Cl. ..... 272/93

[58] Field of Search ..... 272/63, 93, 109, 134, 272/144, 120, 125, 126, 143

[56] References Cited

U.S. PATENT DOCUMENTS

| | | | |
|---|---|---|---|
| 2,855,201 | 10/1958 | Yetton | 272/63 X |
| 3,115,338 | 12/1963 | Acs et al. | 272/126 |
| 3,178,180 | 4/1965 | Morgan | 272/145 |
| 3,540,724 | 11/1970 | Hunter | 272/93 X |
| 3,912,262 | 10/1975 | Micko | 272/144 X |
| 3,947,023 | 3/1976 | Martin | 272/93 |

FOREIGN PATENT DOCUMENTS

| | | | |
|---|---|---|---|
| 648641 | 1/1951 | United Kingdom | 272/63 |

*Primary Examiner*—Richard C. Pinkham
*Assistant Examiner*—Arnold W. Kramer
*Attorney, Agent, or Firm*—Roger A. Marrs

[57] ABSTRACT

An exercising stand is disclosed herein having an elongated base with an underside adapted to be placed on a supporting surface and an upper side substantially divided into a pair of end areas separated by a central area. A plurality of pegs or stand-offs are carried on the base upper side and arranged on each end area in a predetermined pattern or array. A U-shaped hand grip is removably carried on selected pairs of the plurality of pegs associated with each end area so that a variety of exercises can be performed. Clips are carried on the base central area for releasably retaining each of the hand grips in a storage position when not in use on the pegs.

3 Claims, 4 Drawing Figures

FIG. 1
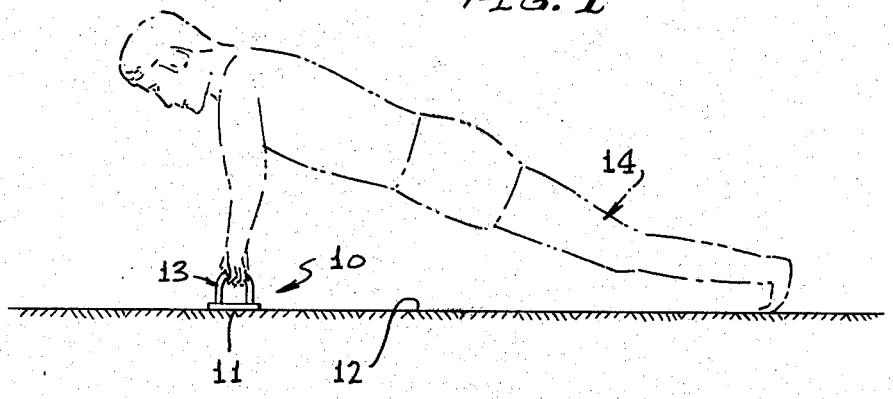
FIG. 2
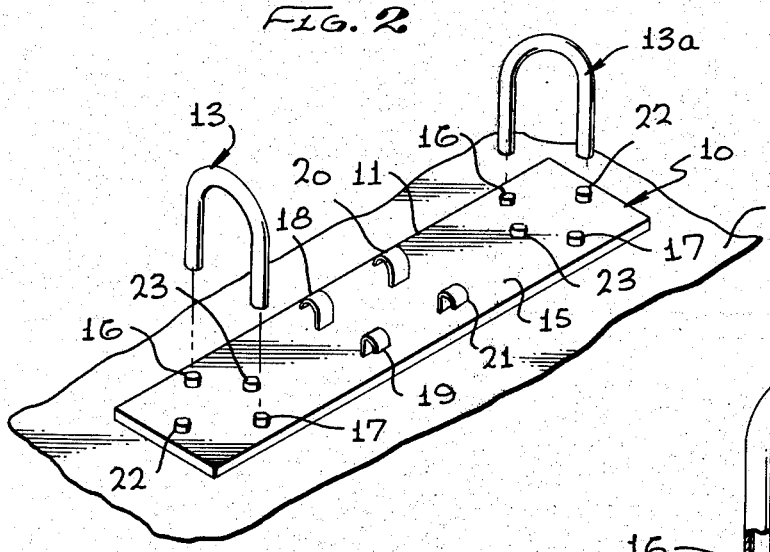
FIG. 4
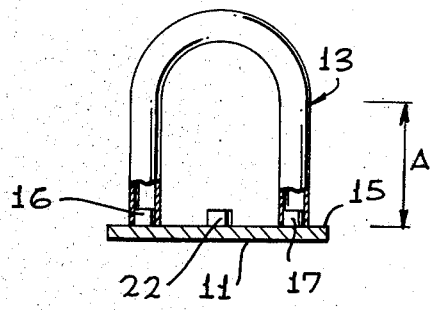
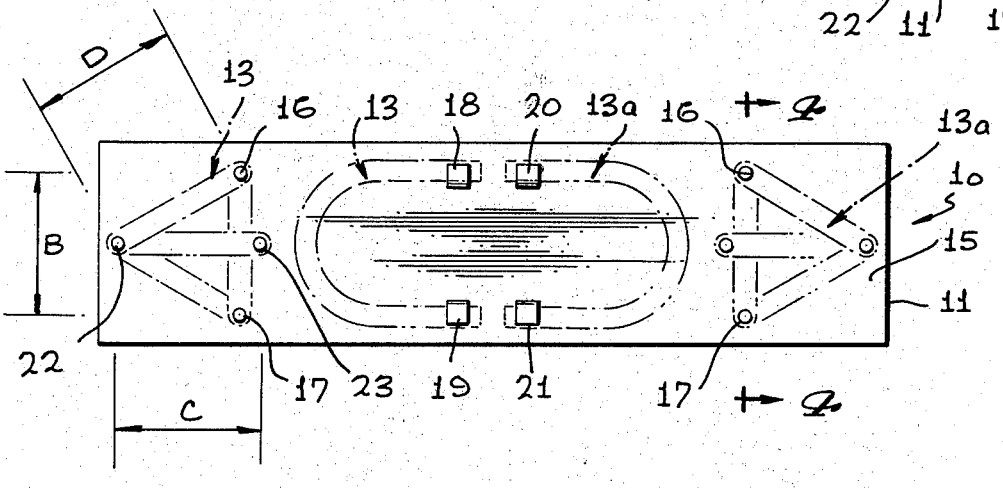
FIG. 3

EXERCISING STAND

BACKGROUND OF THE INVENTION

1. Field of the Invention

This invention relates to physical exercising devices and more particularly, to a novel device adapted to thoroughly exercise the chest, the shoulders and the arms of the body by varying the handgrip placement of the user during a series or sequences of body building exercises.

2. Brief Description of the Prior Art

In general, the concept of exercise, whether for developing the physique or for the purpose of weight reduction, involves expending a substantial amount of time and physical effort to obtain observable results. Furthermore, such exercise or weight reduction frequently requires equipment that is rather expensive and beyond the means of many who desire to excercise or reduce. Many portable exercisers have been employed in the past, but these have usually required the use of weights or resilient members, such as springs or elastic cords, and in addition, have usually been directed to developing particular muscles without regard for the rest of the muscle group or body area. Many of these prior exercising devices have required direct mounting on a wall or the use of a wall for body support, while nearly all of them have required a considerable space in which to use them properly.

However, problems and difficulties have been encountered with such conventional exercising apparatus which stem largely from the fact that conventional stretching devices or push-up stands exercise and therefore develop only one set of muscles in a particular body area while avoiding development of other muscles in the same area. Such problems generally occur because the particular hand grips are stationary and cannot be moved or oriented into other positions or locations so that a greater variety of muscles can be exercised. Furthermore, and particularly when push-ups are being performed, it is extremely important that the person's chest be permitted to drop substantially below the hands so that a full range of movement can be derived. Placing the hands on a flat surface such as the ground or platform does not achieve this purpose.

Therefore, a long standing need has existed to provide a portable exercising stand or device which will permit the user to develop the primary muscles of the chest such as the pectorals and the muscles of the arm such as the triceps.

SUMMARY OF THE INVENTION

Accordingly, the problems and difficulties encountered with conventional exercising devices or apparatus are obviated by the present invention which provides a novel portable exerciser that provides stationary platform means on which the user may selectively position or orient hand grip means so that a variety of chest and arm development exercises may be performed. The stationary platform means comprises an elongated base with an underside adapted to be placed on a supporting surface and an upper side substantially divided into a pair of end areas separated by a mid or central area. A plurality of pegs are secured on the base upper side and arranged on each end area in a predetermined pattern and inverted U-shaped hand grip means is removably carried on selected pairs of the plurality of pegs associated with each end area so that a variety of exercises can be performed so as to develop different muscles in the chest and arm area. A plurality of cooperating clips are carried on the base mid or central area for releasably retaining each of the hand grips in a storage position when not in use on the pegs. The hand grip means are of sufficient height above the upper side of the platform means so that the user's chest can depress therebetween as the user performs push-up exercises.

Therefore, it is among the primary objects of the present invention to provide a novel exercising device which permits the user to exercise muscles associated with major portions of his body by selectively choosing a variety of hand positions on a stationary platform.

Another object of the present invention is to provide a novel portable exerciser for developing primarily the arms, the shoulders and the chest of the user without the use of stationary or fixed wall units and whereby a variety of body muscles can be simultaneously exercised.

Still another object of the present invention is to provide a novel exerciser which is employed in the performance of exercising push-ups wherein the hand grips may be readily positioned with respect to a stationary board in order that the user may exercise and develop different muscles in the tricep group as well as the pectoral group.

Still another object of the present invention resides in the provision of a novel portable exercising apparatus which is readily adapted for use between a storage position and an exercising position and which includes releasable fasteners or clips for holding portions of the device in the storage position.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevational view of the novel exerciser incorporating the present invention illustrated in actual usage by a person shown in a typical position for performing push-up exercises;

FIG. 2 is an enlarged perspective view of the exerciser illustrated in FIG. 1;

FIG. 3 is a top plan view of the exerciser shown in FIG. 2 illustrating a variety of hand grip positions and orientations;

FIG. 4 is a transverse cross sectional view of the exercise device shown in FIG. 3 and taken in the direction of arrows 4—4.

DESCRIPTION OF PREFERRED EMBODIMENT

Referring to FIG. 1, the novel exercising stand incorporating the present invention is indicated in the general direction of arrow 10 which includes an elongated base 11 resting on a supporting surface such as the ground or a floor 12. The underside of the base rests on the supporting surface while the opposite or top side of the base mounts a pair of U-shaped handle grips such as is indicated by numeral 13. The user is indicated by numeral 14 and is illustrated in a typical position for performing an exercise commonly known as a push-up exercise. In the performance of this exercise, it is the usual procedure for the user to maintain his body and legs rigid while grasping the pair of handles in each hand and employing the arms to push the torso away from the supporting surface and then using the arms to lower the torso towards the supporting surface. In such a performance, it is essential that the user's chest be permitted to extend or project deeply between the pair of handles so that a full range of muscle exercise can be gained. Also, it is a well known fact that the angle at which the handles are grasped dictates which muscles of the chest, shoulder and arms are to be employed and therefore exercised. To this end, it is within the inventive concept of the present invention to permit the handles or hand grips 13 to be rearranged on the base so that the user may selectively exercise the desired muscle group.

Referring now in detail to FIG. 2, it can be seen that the upper or top surface of the elongated base 11 is indicated by numeral 15 and that the pair of handles are indicated by numeral 13 and 13*a*. The handles are in position preparatory for insertably receiving selected pegs which are arranged on the top surface of the base 11. For example, handle 13 is in position to be insertably received over pegs 16 and 17 which lie in a plane parallel to the ends of the base 11. When the pair of handles are so arranged on these selected pegs, the user will exercise the three primary muscle groups of the chest and the triceps of the upper arm. Further aleternate arrangements of the handles will be described later. It can also be seen in FIG. 2 that when the handles are not in position for use and it is intended to store the handles and the stand, the handles may be snap locked under clips 18 and 19 with respect to the hand grip 13 and under clips 20 and 21 for the hand grip 13*a*.

As shown more clearly in FIG. 4, the handles 13 are preferably hollow so that the selected pegs such as pegs 16 and 17 may be insertably received in the open ended bore on opposite ends of the hand grip. Preferably, the diameter of the peg is slightly smaller than the diameter of the bore into which it is insertably received so that a snug fit will occur and therefore stabilize the hand grip thereon. Also, it is to be noted that the linear length of the U-shaped hand grip as indicated by the capital letter A is of sufficient distance to permit the chest of the user to project far down before coming into contact with either the supporting surface or the base 11. Although other releasable attachment means may be provided for releasably securing the opposite end of the handle to the board, it has been found that the use of pegs adapted to be insertably received into the open ended bore of the hand grips is an economical and simple means.

Referring now in detail to FIG. 3, the distance between pegs 16 and 17 is indicated by the letter B and as mentioned earlier, the full chest is exercised as well as the triceps when the handles are arranged on these two pegs. When it is desired to exercise the chest, shoulders and triceps the handles may be re-oriented and insertably placed on pegs 22 and 23 which is indicated by the distance C. The pegs 22 and 23 lie in a plane parallel to the opposite side edges of the base 11. When it is desired to exercise the lower pectoral muscles and some arm and shoulders as well as the back, the handles are placed between pegs 22 and 16 as indicated by the distance established according to D. Such an arrangement provides that a plane is established between pegs 22 and 16 which is at a forward or frontal angle with respect to the side edges of the base 11. When it is desired to exercise the upper chest and the shoulders as well as other portions of the arm, the handles may be placed at a reverse or rear angular displacement on pegs 22 and 17 so that a reverse angle is established with respect to the side edges of the base 11.

Although only one side of the stand has been described, it is understood that the same pegs and relationship are established on the opposite end of the board and that handle 3*a* is used therewith. In other words, whatever selected orientation handle 13 is disposed at, handle 3*a* will follow suit with respect to its associated pegs at the opposite end of the board 11. The handles are open ended and insertably receive selected pairs of pegs or studs so that the user can grasp and do push-ups. The handles are placed on a pair of cooperating studs or pegs according to either a vertical, horizontal or diagonal arrangement depending upon which chest, shoulder and arm muscles are intended to be worked.

For storage purposes, the handles may be removed from the pegs after the completion of an exercise procedure and the handles are arranged, as shown in FIG. 3, so that their opposite ends are placed under clips 18, 19 and 20, 21 respectively. When the handles are in this orientation, the board and the handles may be readily stored in a zipper case and either transported from one place to another or placed in a storage compartment such as a closet or garage.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An exercising device for developing the upper torso and arms of the user by performing push-up procedures, the combination comprising:

an elongated base having opposite ends separated by a mid-section and parallel opposite side edges interconnecting said opposite ends;

a plurality of four pegs secured to each of said base opposite ends separated by said base mid-section;

a pair of hand grips detachably carried on selected pairs of said plurality of four pegs associated with each of said base opposite ends;

each of said hand grips being of substantially U-shaped configuration having opposite ends terminating in an open ended bore for insertably receiving said selected pairs of said plurality of four pegs;

each of said hand grips is a hollow tube bent over upon itself to define said U-shaped configuration and said hand grip having a length longer in distance than its width;

said base mid-section constitutes a storage area for said hand grips when removed from said selected pair of pegs;

clip means secured to said mid-section releasably engaging with said hand grips for retaining said hand grips on said base for storage; and said plurality of four pegs are arranged so that said selected pairs of said plurality of four pegs are selected from a pair of pegs which are on a plane parallel to said opposite base side edges, normal to said opposite base side edges or angularly disposed with respect to said opposite base side edges.

2. The invention as defined in claim 1 wherein:

said base includes an under surface contacting a supporting surface and an upper side carrying said plurality of pegs.

3. The invention as defined in claim 2 wherein:

said pegs extend a substantial distance into each end of said tubular hand grips so as to support and retain each said respective hand grip in position thereon.

* * * * *